US005131686A

United States Patent [19]

Carlson

[11] Patent Number: 5,131,686

[45] Date of Patent: * Jul. 21, 1992

[54] METHOD FOR PRODUCING IDENTIFICATION CARDS

[76] Inventor: Thomas S. Carlson, 19 Mid Oaks Rd., St. Paul, Minn. 55113-5612

[ * ] Notice: The portion of the term of this patent subsequent to Mar. 17, 2009 has been disclaimed.

[21] Appl. No.: 632,316

[22] Filed: Dec. 21, 1990

Related U.S. Application Data

[63] Continuation-in-part of Ser. No. 585,614, Sep. 20, 1990.

[51] Int. Cl.[5] ..... B42D 15/00

[52] U.S. Cl. ..... 283/75; 283/67; 283/107

[58] Field of Search ..... 283/75, 67, 70, 74, 283/85, 86, 107, 108, 109, 110

[56] References Cited

U.S. PATENT DOCUMENTS

| | | |
|---|---|---|
| 3,273,785 | 9/1966 | Beckman et al. . |
| 3,319,872 | 5/1967 | Beckman et al. . |
| 4,447,481 | 5/1984 | Holmberg et al. . |
| 4,525,116 | 6/1985 | Holmberg . |
| 4,590,109 | 5/1986 | Holmberg . |
| 4,618,520 | 10/1986 | Holmberg . |
| 4,780,974 | 11/1988 | Mitchell . |
| 4,951,864 | 8/1990 | Dicker . |

OTHER PUBLICATIONS

"8 out of 10 Businesses Can't Be Wrong", Form May 1989, p. 90.

Avery Label Company (Reference 2), instructions for fold over film.

Reference 3—samples of base paper sheet with imprintable film adhered (Avery Label Company, Hunkeler Corporation and Gluefold).

Reference 4—Unique Embossing Services—copy of laser printable plastic die cut to form indentification cards.

Reference 5—"tipped on ID cards"—copy of literature from Hunkeler Corp., Infoseal System, Champion Business Forms, Vanier Graphics & Gluefold.

Reference 6—Composite Technologies, Inc. copy of literature regarding paper sheet stock to which plastic is adhered.

*Primary Examiner*—Timothy V. Eley
*Assistant Examiner*—Willman Fridie, Jr.
*Attorney, Agent, or Firm*—Vidas & Arrett

[57] ABSTRACT

A sheetstock for preparing mailers including die-cut identification cards which may be printed with a laser printer. The sheetstock includes a laser printable plastic adhered to a portion of the sheetstock. That portion is die-cut to define one or more identification cards. The remainder of the sheetstock includes a second layer of paper adhered thereto which allows the sheetstock to feed through a laser printer feed tray. Alternatively, the paper is indented to allow for the added thickness of the adhesive and plastic layers.

21 Claims, 7 Drawing Sheets

30
32
34
16
18
32
26
52
12
28
10

30
22
20
16
26
20
22
52
12

METHOD FOR PRODUCING IDENTIFICATION CARDS

CROSS-REFERENCE TO RELATED APPLICATIONS

This application is a continuation-in-part of application Ser. No. 07/585,614 filed Sep. 20, 1990 by the inventor under the same title.

BACKGROUND OF THE INVENTION

1. Field of the Invention

This invention relates to identification cards, and more particularly to methods for forming plastic cards printable in a printing process, especially in a laser printer.

2. Description of the Related Art

Previous methods for making identification cards produced embossed plastic cards and plain paper cards. Embossed cards are relatively expensive to make. Plain paper cards are inexpensive, however, they are not long lasting and do not convey a polished image. The image can be chipped off paper fibers. Also, the cards were not water resistant.

Plastic cards have been produced in which an impact printer is used to mark a sheet of die-cut plastic, tipped-on plastic, plastic-coated paper and some full sheet plastic cards. Such printers have relatively poor quality and are unable to form quality bar codes and graphics on such cards on the same care and sheet. Full sheets coated entirely or substantially with plastic on areas other than the card are environmentally wasteful, cost more and cause greater recycling problems.

Continuous forms with tipped on cards running through cold fusion or impact printers ofter fall off due to the difference in the thickness between the form carrier and the tipped on plastic card. This difference in thickness may cause the printer to snag on the card or otherwise malfunction.

Laser and ionographic printers are able to form high quality text and graphics on paper and some plastics. However, due to their construction, laser and ionographic printers are finicky and are often unable to handle varying thickness of paper on the same sheet. Likewise, many inkjet printers are unable to accurately print sheetstock that varies in thickness without jamming somewhere in the machine.

Many companies wish to send plastic identification cards to customers along with a cover letter of paper. Previous attempts to use laser or ionographic printers have failed to produce acceptable paper pages bearing plastic die-cut identification cards.

SUMMARY OF THE INVENTION

The invention has developed a method in which industrial high speed hot and cold fusion laser printers, inkjet printers and ionographic printers can rapidly produce plastic identification cards that can be popped out of a paper letter format. A plain sheet of paper is utilized as the "core" to which laser printable plastic may be applied to the front and optionally the back over a portion of the sheet sufficient to form the number of cards desired.

The cards are formed by conventional die cuts or tipped-on plastic layers which allow a user to remove the cards fromt the sheet when desired. The remainder of the sheet must be substantially covered with a second layer of paper or other sheet stock to increase the thickness of the sheet to that approximating the thickness of the plastic-coated portion. If plastic is applied to both sides, a space of at least about 1/16" between the plastic coated portion and the second paper layer coated portion may act as a hinge to allow the sheet to feed and travel through the printer evenly. Alternatively, the paper may be recessed such that the plastic layers may be added without increasing the overall thickness of the paper sheet. In such applications, no gap is needed.

It has been found that a sheet of paper bearing a plastic coated section with teh die-cut cards will not properly feed in many printers. the paper feeding, paper transport, fusing system imaging systems, paper output and input and timing registration devices in many laser printers are extremely sensitive to variations in thickness and weight distribution of paper or plastic sheets. When a sheet of paper having a plastic-coated section is to be fed into a laser printer, the paper feeding and imaging process falls out of alignment, causing many of the images on the sheets to be misaligned and poorly imaged by the laser printer. In addition, the paper may jam in the machine and in the output hopper.

The inventor's solution to this vexing problem places a second layer of paper over most or all of the paper which is not covered by plastic. This second layer makes a stack of such sheets feed smoothly into and through laser printers without jams, misalignments or poor imaging. The second layer also make the paper more level and even when stacked in the laser printer's infeed and outfeed hoppers and in shipping and storage. The space left between the plastic and second layer ensures this uniform feeding by hinging the sheet even when a plastic coating is placed on the bottom as well as the top of a portion of the sheets. The paper sheet effectively flexes to maintain a flat profile. The recessed form of the invention provides the same benefits by equalizing the thickness of the sheetstock by indenting the paper and plastic layer.

BRIEF DESCRIPTION OF THE DRAWINGS

A detailed description of the invention is hereafter described with specific reference being made to the drawings in which.

DESCRIPTION OF THE PREFERRED EMBODIMENTS

EXAMPLE 1

Figure 1:
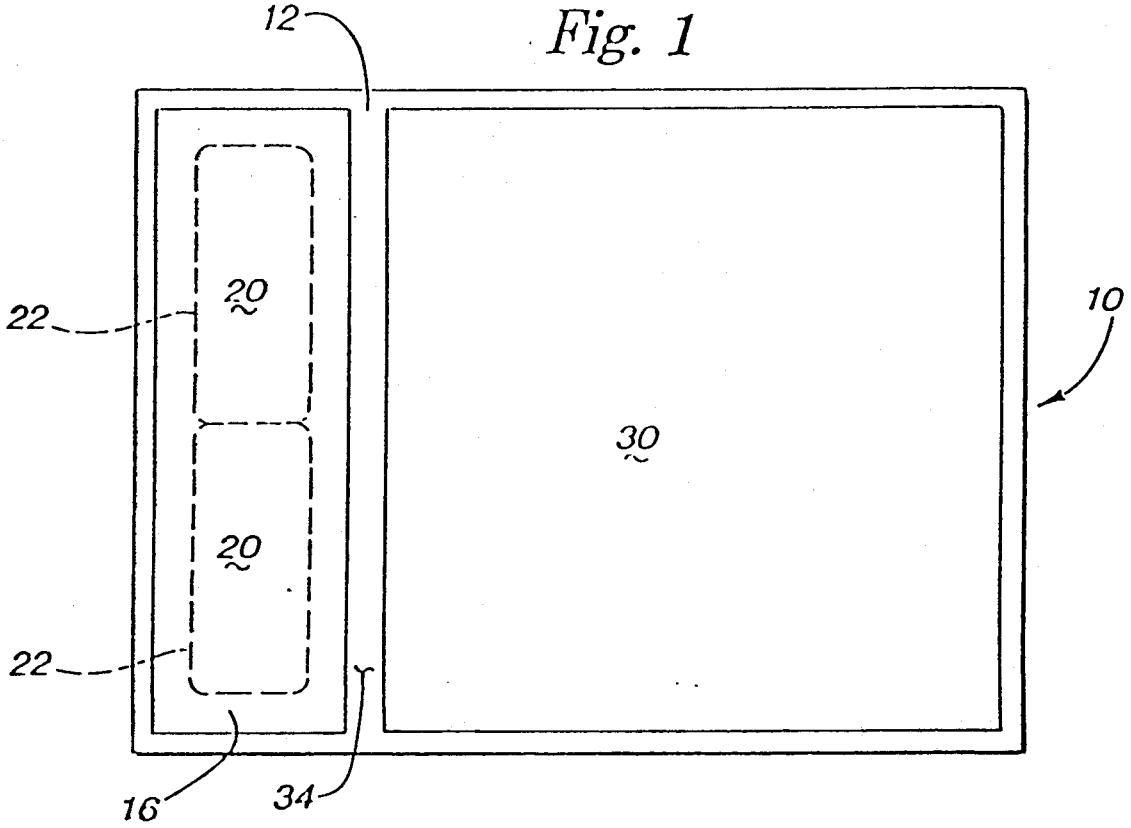
FIG. 1 is a top view of a page of sheet stock bearing text and die-cut identification cards.
Figure 3:
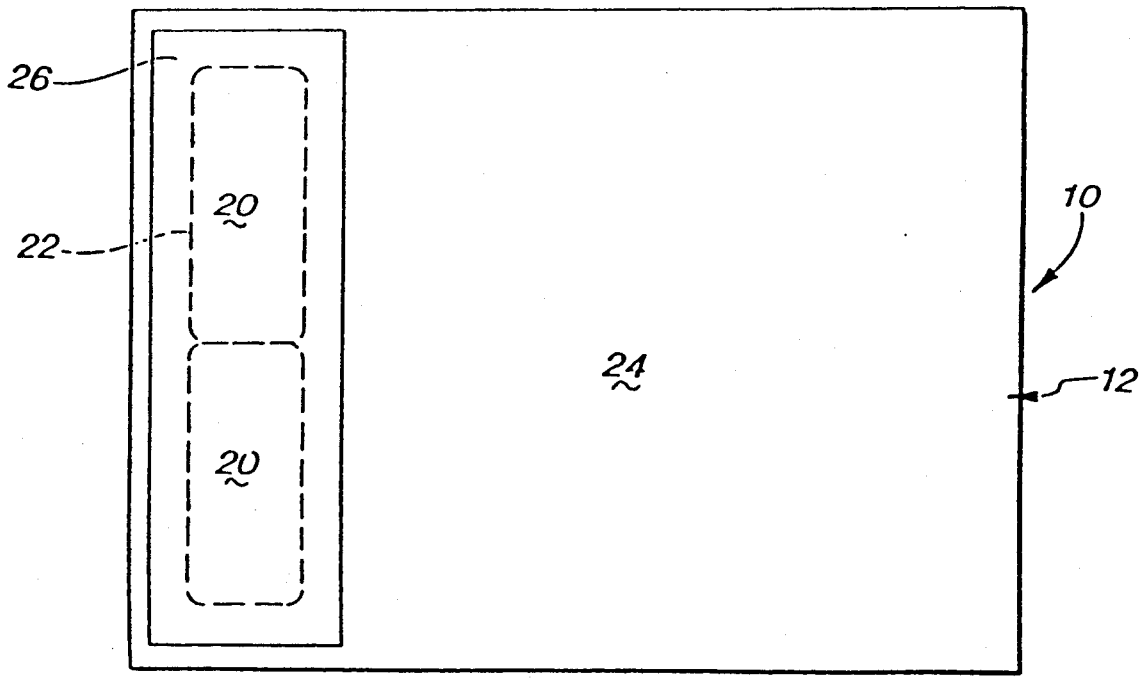
FIG. 3 is a bottom view of the sheetstock of FIG. 1.

With reference to the Figures it will be senn that sheetstock 10 is formed from a page of paper 12 to which a top layer of plastic 16 is laminated or otherwise adhered by adhesive 18. Plastic layer 16 is fabricated from the plastic coatings which are currently in use in laser printing. Such plastics or other coatings must facilitate and accept the transfer and adhesion of laser imaging toners. Since such applications involve substantial heat, these plastics are quite resistant. A suitable plastic is available from Dunmore Corporation of Newtown, Pa. marketed under the designations 200 Dun-Kote 683, CITC. Polyester plastics are often used. Low static plastic and coatings are desirable. If cold fusion laser printers, ionographic printers, inkjet printers or impact printers are to be used, the constraints on the plastic types will vary.

Identification cards 20 are formed in the plastic/paper composite by die cutting the sheetstock. Such die cuts 22 are well known and include a combination of ties and slits that allow the card 20 to remain together through identification card production and laser printing equipment until the recipient pops it out of the sheet. The slits completely penetrate all layers of the composite. To keep the card in place and from popping out in the laser printer, ties should be left at all corners. Alternatively, the plastic may be tipped on in exactly the required size, eliminating the need to die cut the plastic when on the substrate paper. The excess plastic around the die cuts may be peeled away if desired, such as with mailing label sheetstock.

The cards to be formed are preferably plastic on both sides to provide a better looking and longer lasting ID card. The back 24 of sheetstock 10 may include a bottom layer of plastic 26 laminated or adhered by adhesive 28 to paper 12 as with the front layer 16. The bottom layer need not be laser printable if the information is already printed on that sheet (as in the case of unchanging information about the supplier).

It has been found that a sheet constructed as described above will not work satisfactorily in many laser, ionographic or inkjet printers. The papers may not be fed into or be transported through the printers properly. The paper may also be slightly out of alignment when travelling through the printer which causes the cards created to be imperfect at the least and possibly unusable. The sheetstock must include a second layer of paper 30 (or other sheetstock such as a pressure sensitive label stock material) adhered with adhesive 32 (or other attachment means) to page 12 as shown in the Figures. This second sheet of paper or plastic is applied over substantially the entire surface of page 12 which is not covered with plastic 16. This top paper layer 30 could readily accept any laser printing and causes the sheetstock to feed evenly into, through and out of the laser printer. Example 6 describes a form of the invention using similar principles in which recessed paper is employed instead of two layers of paper.

If a second layer of plastic 26 is present on back 24, a gap or space 34 is preferably maintained between top paper 30 and plastic 16. This gap makes the sheetstock slightly more flexible at that point and functions as a hinge to keep the paper flatter as it travels through the laser printer's infeed device, paper transport, output systems, imaging and fusing systems. This allows the paper to flex slightly and to compensate for the fact that the plastic 26 on the back 24 makes the sheet uneven. This allows the plastic and paper to have space to move freely, independently so that they don't snag each other as the paper shifts when it is struck by fusing and imaging rollers of the printer. However, the thickness of the top paper 30 is selected such that the thickness through the sheetstock at the second paper 30 is approximately equal to the combined thickness of the page 12 and plastic 16 and 26 together with the adhesives. When so constructed, the sheetstock will feed smoothly, stack evenly and print properly in a laser printer.

When the paper and plastic layer are thinner, there is less need for a gap. In fact, as the plastic layer becomes thinner, only the separation line may be required. Instead, the mere break line between the second sheet 310 and the plastic 16 may be suficient. The gap or space 34 must be at least about one-sixteenth of an inch (1/16) and preferably at least about ⅛" to ¼" to allow this flexibility with thicker paper and plastics. The second sheet of paper 30 basically compensates for the presence of the plastic layer on an end of the sheet by equalizing the thickness and rebalancing the sheetstock. The internal synchronization systems of the laser printers work well when the paper sheet is added to balance the weight distrabution and to equalize the thickness of the sheetstock. Generally, the more of the surface of the page 12 is covered by second paper 30 the better, with the exception of the need for space 34.

EXAMPLE 2

Figure 6:
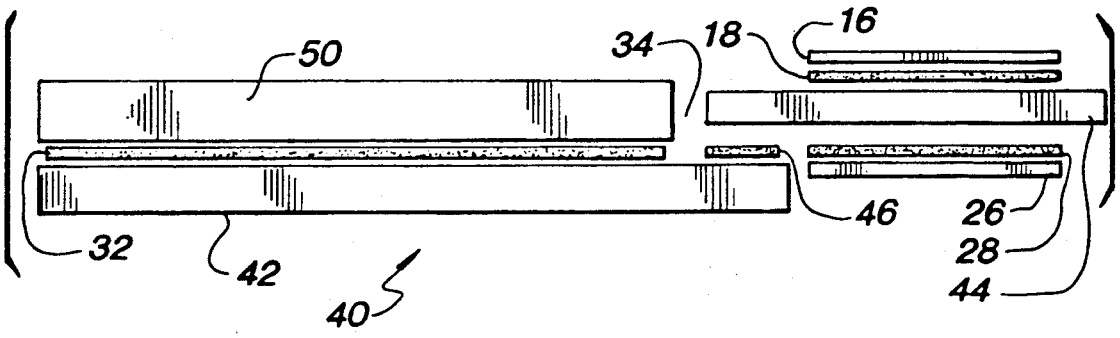
FIG. 6 is a cross-sectional view of the embodiment of FIG. 5.
Figure 5:
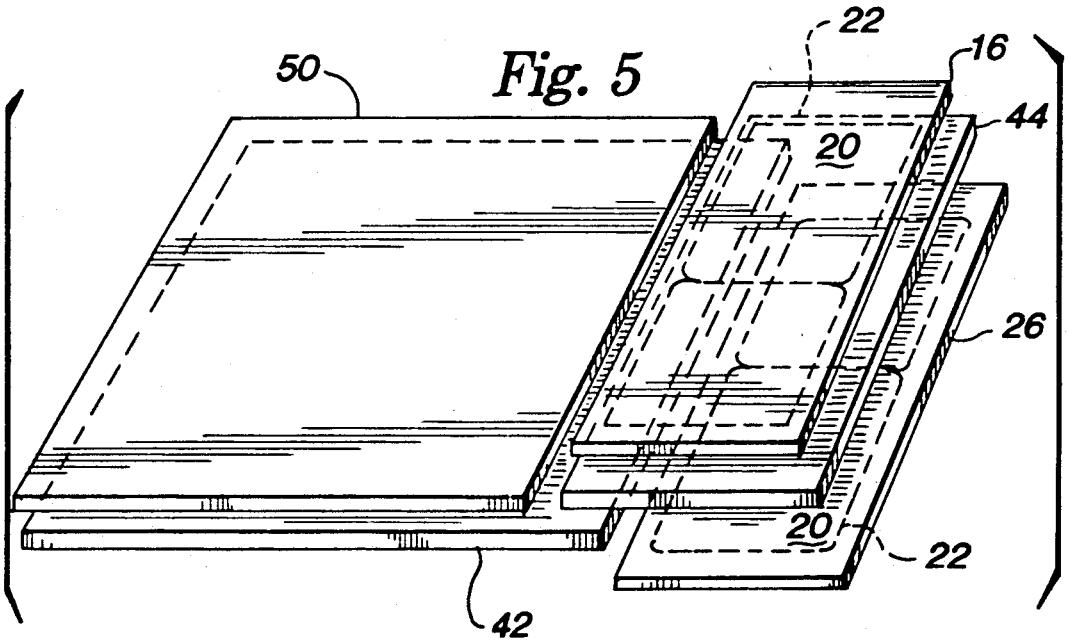
FIG. 5 is an exploded view of an alternate embodiment in which the main sheet does not extend the full length.

The advantages and benifits of the invention may also be realized with the alternate constriuction shown in FIGS. 5 and 6. With reference to the figures it will be seen that sheetstock 40 includes a paper or plastic layer 42 which unlike sheetstock 12 does not extend the full length of the completed article. Instead, teh sheetstock 40 is formed by attaching a second layer 44 to layer 42 by adhesive 46. The top plastic 16 and bottom plastic 26 are attached to layer 44 with adhesive 18, 28 respectively.

The use of a second layer 44 to complete the length may reduce or eliminate the need for any gap 34 between the scab sheet 50. Layer 44 may be thinner than layer 42 such that the overall thickness of the sheetstock 40 is nearly identical across the entire sheet. Layer 44 may be plastic or paper. Also, the profile in cross-section may be that the exposed surface of layer 42 and layer 26 are nearly co-planar. This prevents the problems described previously with feeders in laser, ionographic and inkjet printers. No gap would be needed if the outside surfaces of the sheetstock are nearly co-planar.

The construction shown in FIGS. 5 and 6 would probably require running two webes of paper/plastic through a rotary press. The layer 42 would be adhered to layer 44 during such a run. The plastic layers 16 and 26 could then be added as desired by unwinding and adhering one or more paper or plastic layers onto layer 44. Die cuts 22 to form cards 20 would also need to be added. Scab sheet 50 could be attached with releasable or non-releasable adhesives in the same or in a separate run. It may include a release liner and die cuts as is known in the art to allow release of all or a portion of layer 50 at a later time to be used as a label.

EXAMPLE 3

Figure 8:
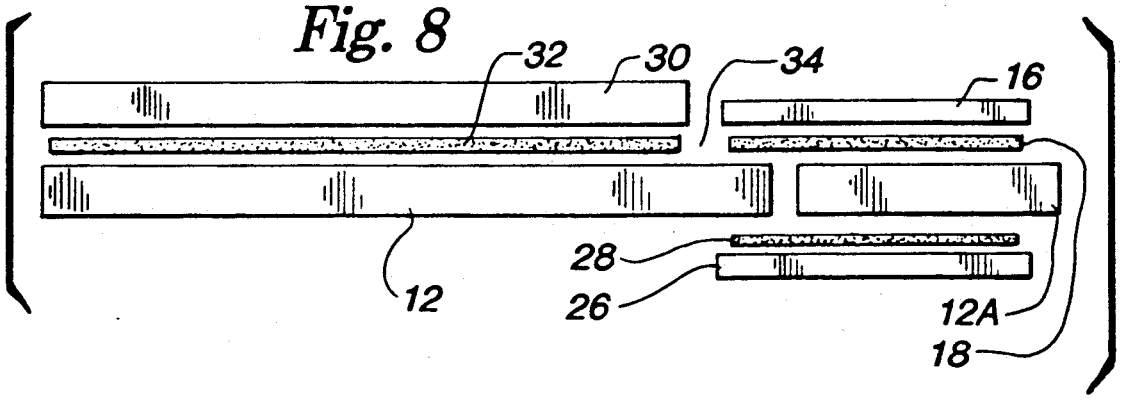
FIG. 8 is a cross-sectional view of the embodiment of FIG. 7.
Figure 7:
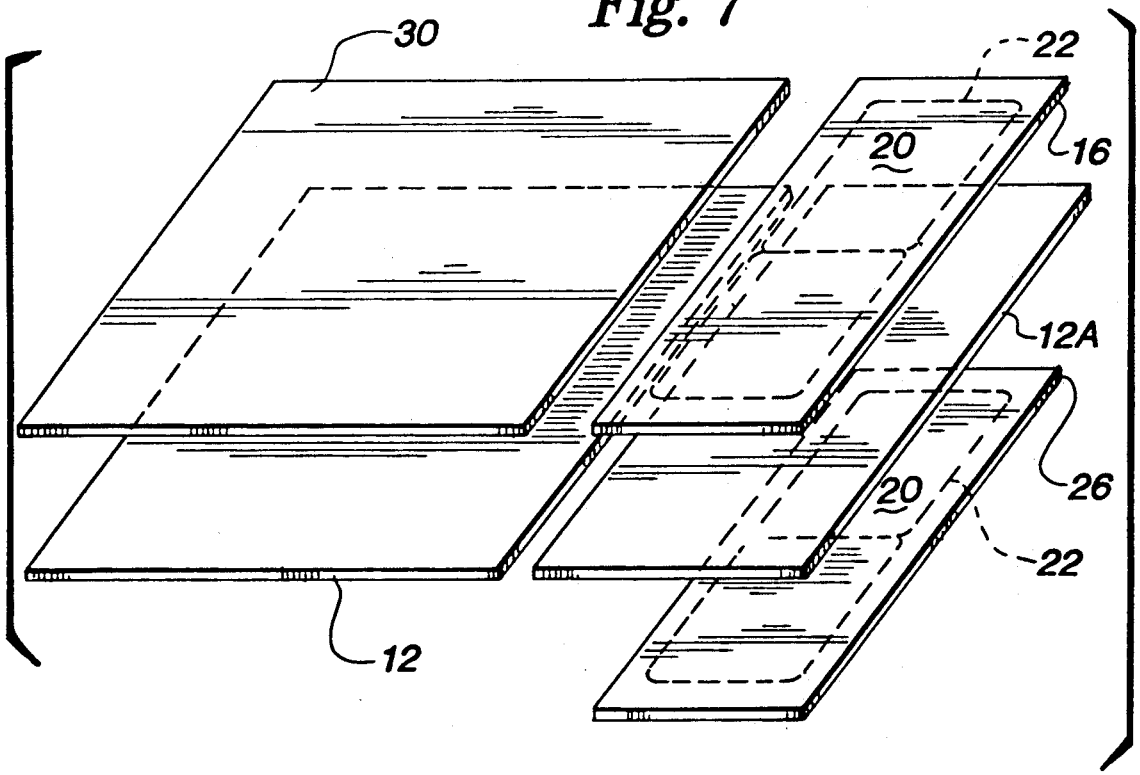
FIG. 7 is an exploded view of a second alternate embodiment in which the main sheet does not extend the full length.

Another embodiment of the invention is shown in FIGS. 7 and 8. The construction of hte sheetstock of FIGS. 7 and 8 employs a twin web gluing process such as in FIGS. 5 and 6. However, rather than overlapping the sheets, it is possible to adhere them together by the adhesive and plastic layer. As shown, layer 12 is broken into two parts, 12 and 12A. They may be of the same material aand thickness or may vary. Layer 12A may be paper or plastic.

Layers 12, 12A are held together by the adhesive connection formed by adhering plastic layers 16, 26 with adhesives 18, 28 to the layers12, 12A. The overlap of the plastic layers 16 and 26 secures layers 12, 12A together. Like reference numerals are used to identify features described previously.

EXAMPLE 4

Figure 2:
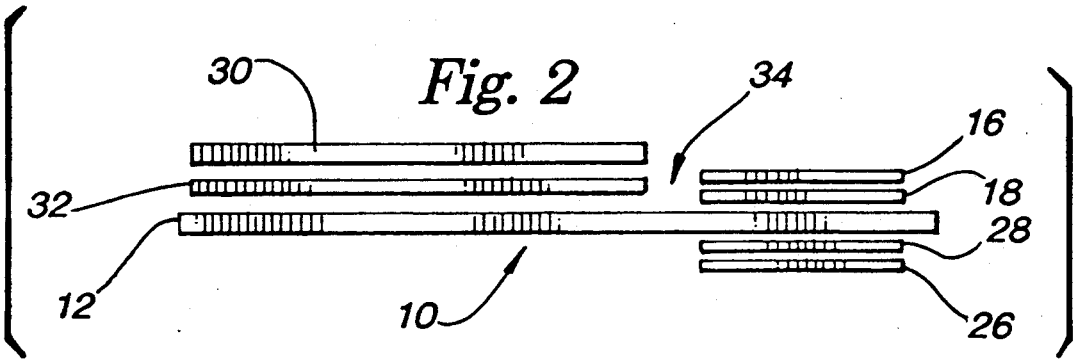
FIG. 2 is a cross-sectional view of the page of FIG. 1.
Figure 4:
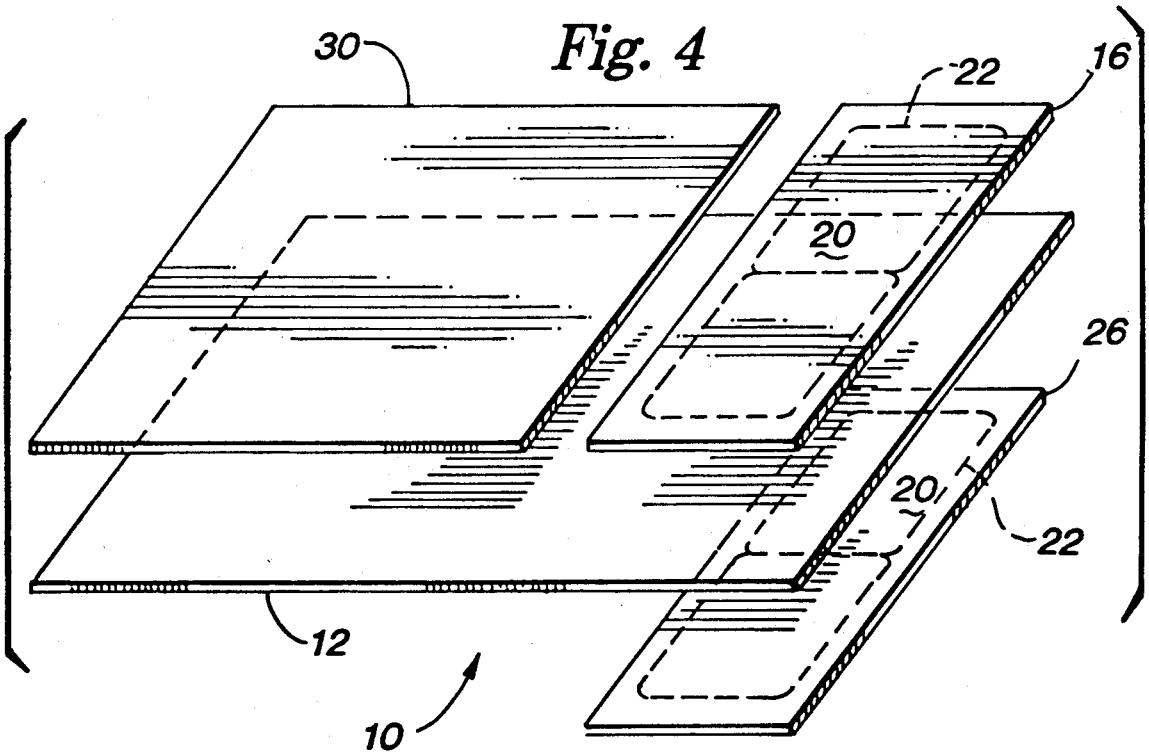
FIG. 4 is an exploded view of the sheetstock of FIG. 1 showing the plastic and paper layers without adhesive being shown.
Figure 10:
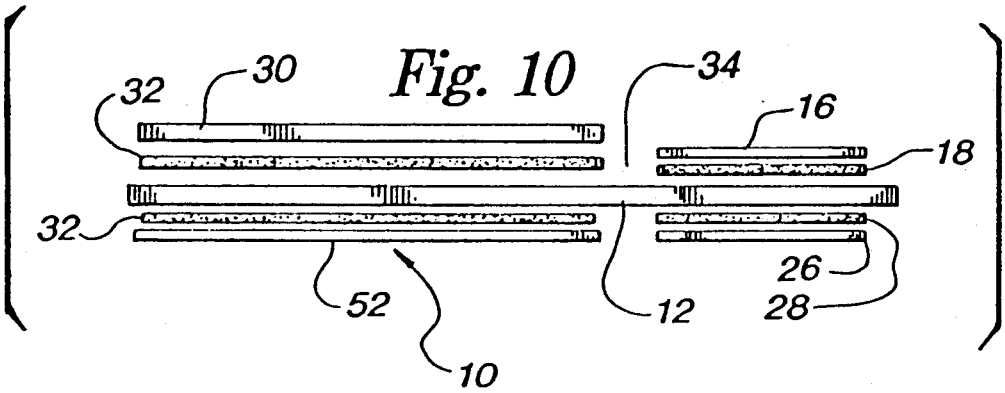
FIG. 10 is a cross-section view of the embodiment of FIG. 9.
Figure 9:
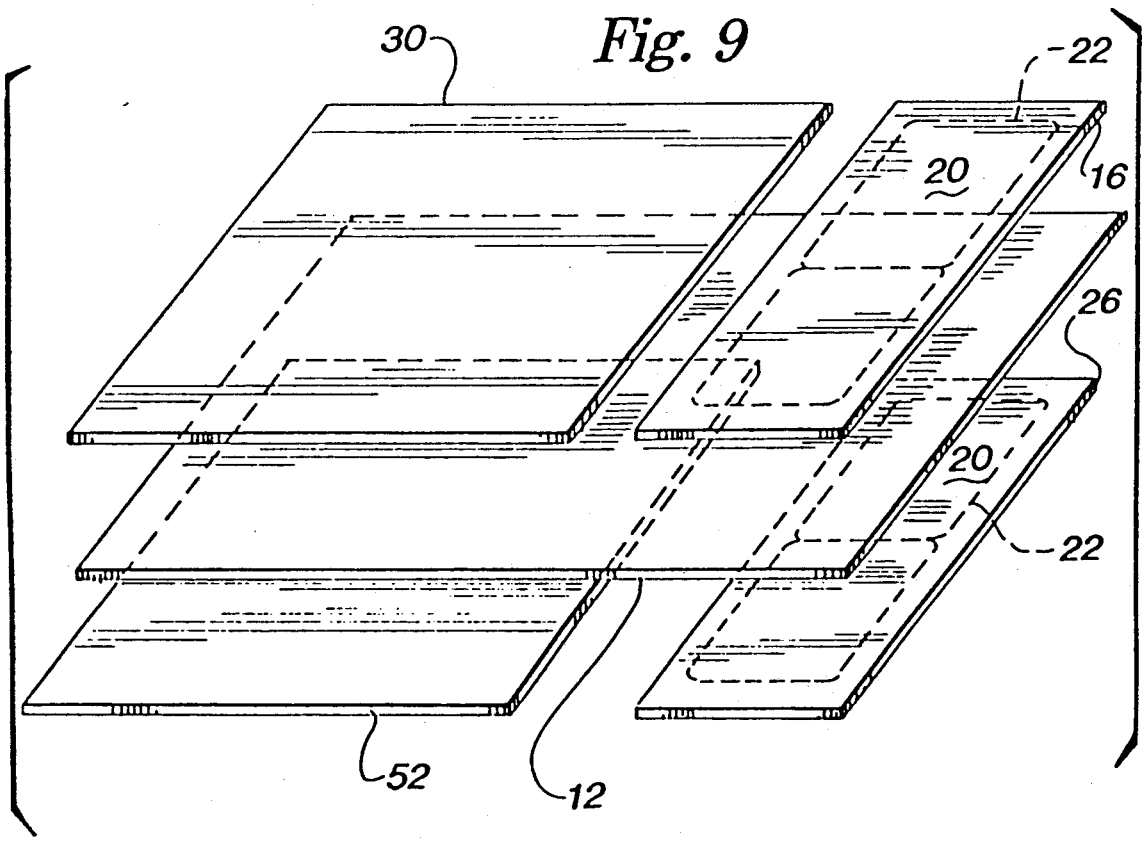
FIG. 9 is an exploded view of a third alternate embodiment in which another scab sheet is added.

The embodiment of FIGS. 9 and 10 is very similar to the embodiment of FIGS. 2 and 4. The embodiment adds a bottom scab sheet 52 in addition to top sheet 30. This bottom scab sheet 52 may be identical to sheet 30 or may be formedc from a different material or thickness. It may be adhered with a releasable adhesive or permanent adhesive 32. The addition of the bottom scabe sheet makes it possible to make the thickness of the sheetstock 10 through the sheet 30, 52 sections the same as that through layers 16, 26. More importantly, it makes it possible to present outside surface to the sheet stock 10 which are coplanar across the entire surface. This not only eliminates the need for gap 34 but allows the sheetstock to feed well through laser printers.

This form of the invention may require an additional process step to apply sheet 52. However, it may be applied simultaneously with plastic layer 26.

EXAMPLE 5

Figure 12:
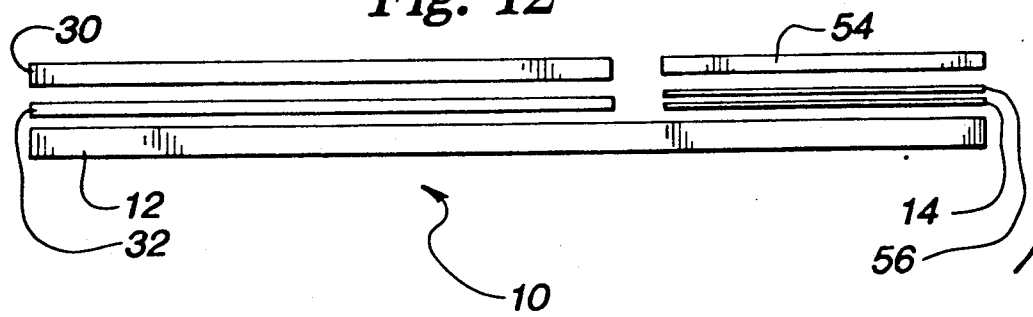
FIG. 12 is a cross-sectional view of the embodiment of FIG. 11 with the addition of a release liner.
Figure 11:
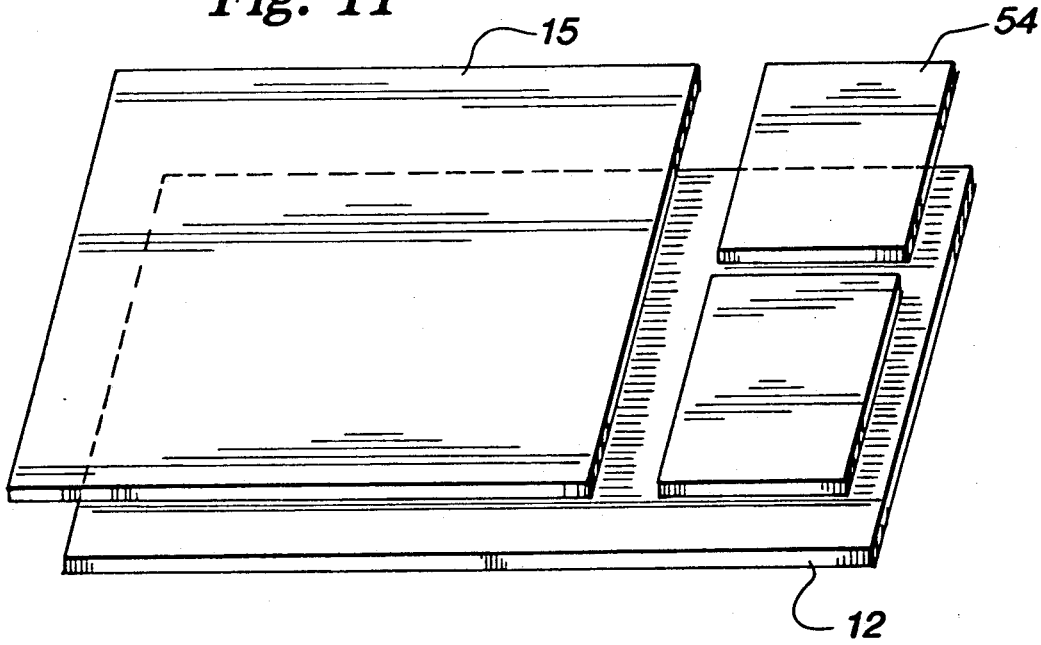
FIG. 11 is an exploded view of a fourth alternate embodiment of the invention in which pre-formed plastic cards are added.

FIGS. 11 and 12 show that the plastic layers can be applied in the form of cards 54 which are applied to the paper 12 without the need for die in cuts in the plastic. Cards 54 to be affixed to the sheetstock may be plastic, paper or a combination of paper and plastic. Perferably, the top layer of the cards 54 would accept laser printing. The cards may be held to paper 12 directly with adhesive 14 or may be adhered to a release liner 56. Release liners may not need adhesive to adhere to paper. Alternatively, the card may include layer 14, 54 and 12 by die cutting layers 14, 54.

EXAMPLE 6

Figure 14:
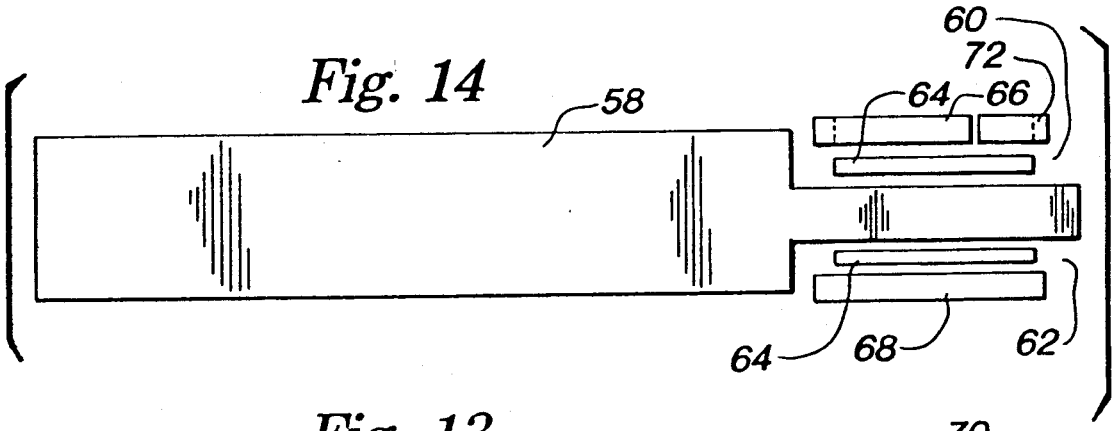
FIG. 14 is a cross-sectional view of the embodiment of FIG. 13.
Figure 13:
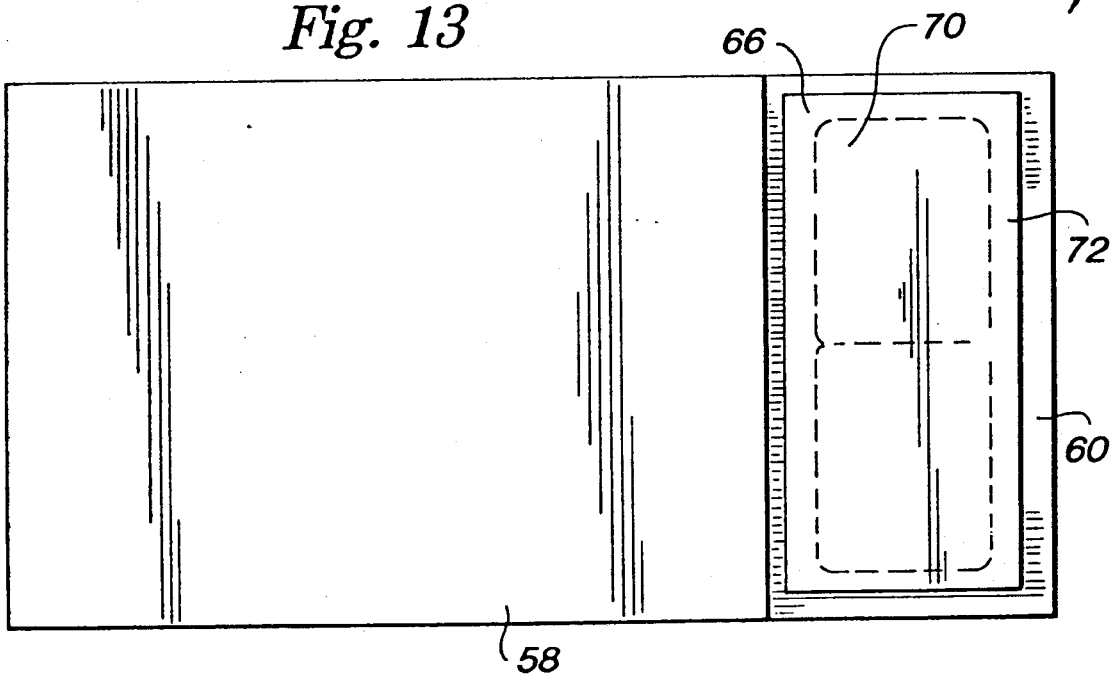
FIG. 13 is an exploded view of a fifth embodiment of the invention in which the paper is recesed.

FIGS. 13 and 14 show another embodiment of the invention in which the main sheet of paper forming the sheetstock is recessed on one or both sides to form spaces into which the laser-printable plastic may be applied. In this manner, the recesses function in the way that the main sheet and scab sheets function. The recesses allow the finished sheetstock to have coplanar surfaces which will feed well through printers. The plastic needs to be fairly thin to ensure that the weight distribution is not unduly unbalanced. The recess may be anywhere on the sheetstock. There may be more than one recess on the sheet. Die cuts through the layers will form the completed cards.

Figure 15:
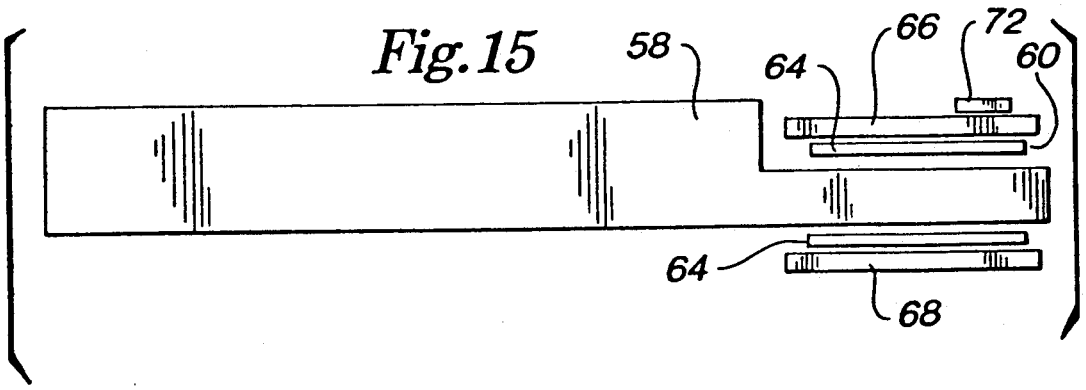
FIG. 15 is a cross-sectional view of an embodiment similar to FIG. 14 except it has no second recess.

In FIG. 13 it will be seen that the sheetstock 10 is largely formed by single sheet 58 which is formed with two recessed areas 60, 62. If desired, only a single recess may be used. A plastic layer may be added top the opposite of the paper of the recess if two layers of plastic are desired without employing two recesses, as shown in FIG. 15. The recesses may be formed by a compression method or any other method such as described in U.S. Pat. No. 4,447,481. The plastic may also simply be crushed into the paper until it is effectively recessed. A laser imprintable coating or other coating may be added to the plastic after this step. The recessed areas 60, 62 receive adhesive 64 which secures plastic layers 66, 68 to the sheet 58.

Layers 66, 68 are as described with respect to plastic layer 16 previously, and adhesive 64 is as previously described. The plastic layers are then die cut to form identification cards 70 as in a manner previously described. With this design it is possible to form the cards on a sheetstock that requires no gap. The sheetstock will be even on a sheet-feeder and will feed smoothly therethrough.

Reference numeral 72 refers to a strip of magnetic material on a plastic substrate which will function as an information carrying device on the cards. The strip may be coated to provide protection to the media. The magnetic strip may be the same as any conventional strips which are currently found on many bank cards. The magnetic strip may be added to any of the cards of the invention, and may be added as a separate layer as in FIG. 15 or next to the top plastic 66 as in FIGS. 13, 14. In FIG. 13 the die cuts pass through the strip 72 and the plastic 66 to define the outline of the card 70 which may be separated later. In a similar manner, holographic images may be formed into the cards of the invention.

PREPARATION OF SHEETSTOCK

Sheetstock 10 may be prepared in any procedure currently utilized for attaching layers of plastic or paper to a page, such as in advertising flyers or labels. One method for forming the sheetstock would be to attach second paper layer 30 to paper pages 12 and roll that product onto a large roll to reduce curling the paper stock and subsequent memory curl in the plastic and paper. The paper can then be unwound to a station in which the plastic layer 16 is adhered. The paper may then be rewound onto a roll and unwound to apply the bottom plastic 26. The completed product may be die cut and then be fed to a sheeter where the roll of material is cut to conventional lengths and the cut singles are stacked. It is also possible to form the sheetstock in a single step by applying the plastic layers lengthwise or cross-wise to the paper roll which allows plastic and paper to be adhered simultaneously. Die cuts may be added during this process at any stage that is convenient. The paper would then be cut to convert it from a "landscape" orientation to a "portrait" orientation.

It has been found that the paper utilized is preferably a 24 pound wove paper. Such paper typically has a thickness of about 0.0045 inches which when adhered to the second paper layer area provides a sheetstock thickness of about 0.010 inches. The plastic layers 16 and 26 are then typically about 0.002 inches each, which combined with the paper page 12 and adhesive gives a combined thickness of about 0.0010 inches. A thicker paper may be required if recesses are to be formed.

Preferably, the laser toner will use a magnetic ink character recognition type toner which fuses better to the plastics and is less susceptible to flaking from the plastic or migration to other plastics. The adhesives should be selected with the application in mind, that is, they must be able to withstand the high temperatures to be encountered in the laser printing process. Any of the commonly used adhesives for such applications involving plastic and paper adhesives may be used. Suitable glues are described in U.S. Pat. No. 4,951,864. They include vinyl acetate copolymer dispersion adhesives such as a vinyl acetate homopolymer emulsion base having a 58-61% solids content, a formulated resin adhesive with dextrine having a 66% solids content or a resin remoistening adhesive having a 66% solids content. If the adhesive employed allows the plastic to peel free from the paper without fiber tear a coating may be applied to the plastic which will improve the adhesion of the plastic to the adhesive and paper. A wide variety of such primers may be utilized. Also, the plastics 16, 26 may be coated with a coating to improve the ability of the plastic layer to accept laser toner.

The sheetstocks 10 thus formed may include a perforation line (not shown) in space 34 to allow the cards 20 to be separated from the upper portion of the sheetstock and to flex more easily. The upper portion of the sheetstock bearing the second paper layer 30 may contain markings, perforations and information such that it can function as a return mailer. It may also include die cuts for labels, may carry blown-on labels or may be held to the main sheet by a releasable adhesive and release liner system. In such cases, the upper sheet could carry, for example, stickers with emergency phone numbers.

Although the invention is needed most in sheet fed laser printers, it may also be utilized in continous feed form and would include register holes to align with pins on the printer. In any case, the invention provides sheetstock which may carry a written message on the second paper or plastic layer 30, back 24 and quality laser printing on both sides of the identification cards 20.

This high quality of laser printing, ionographic or inkjet printing allows the placement of printed machine readable bar codes, optical character recognition (OCR) or magnetic ink character recognition (MICR) on the cards 20. MICR toner uses a ferromagnetic dry ink. Such information means that a holder of such a card may display it at a doctor's office where the bar code is scanned and read, greatly speeding up the process and requiring fewer personnel to make insurance claims. Adding a magnetic strip allows the encoding of a great deal of information which may be electronically read. Although the configurations of the invention described herein are ideally suited for cut sheet laser printers, they have benefits for the other imaging technologies previously mentioned.

The use of the term "identification cards" herein encompasses bag tags, recipe cards, advertising standup cards, wallet id cards, business cards, credit cards, airline tickets, index cards, tickets, key ring cards and other relatively small cards which bear imprinted identification information.

Whenever "adhesive" is referred to herein it must be remembered that any means for adhering or otherwise attaching the paper and plastics together may be utilized. Thus, pressure and heat may be used to attach the plastic layers to the paper.

While most of the examples specifically refer to the invention and its usefulness with hot fusion laser printers, the invention is usable in ionographic printers, inkjet printers, and cold fusion laser printers where a flat configuration must be maintained for good performance. Reference to the term "laser printer" herein is for ease of reading and does not limit the scope of the invention to laser printers.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. Sheetstock for preparing identification cards printed with a printing process of the laser, ionographic or inkjet type; comprising:

a) a sheet of paper having a top, bottom and an upper and lower surface;

b) a first layer of printable plastic adhered to a portion of the upper surface of said sheet, said sheet and plastic layer including a plurality of cuts to define therewith at least one identification card; and c) said paper sheet further including a second layer of paper or plastic adhered thereto over substantially the remainder of said upper surface not coated by said first plastic layer.

2. The sheetstock of claim 1 further including a second layer of plastic adhered to a portion of the lower surface of said paper sheet directly underneath said first plastic layer, said cuts being through all layers to allow removal of said cards so defined, said second layer of paper being spaced from said first layer of plastic by at least one-sixteenth of an inch.

3. The sheetstock of claim 1 including a plurality of die cuts therethrough which defines two or more removable identification cards each sharing a common border by said die cuts.

4. The sheetstock of claim 1 further including a second layer of plastic adhered to a portion of the lower surface of said paper sheet directly underneath said first plastic layer, said cuts being through all layers to allow removal of said cards so defined, said sheetstock further including a third layer of paper adhered thereto over substantially the remainder of said lower surface not coated by said second plastic layer.

5. The sheetstock of claim 1 wherein said identification card includes at least one perforation therethrough which a line may be passed such that said card may function as a tag.

6. The sheetstock of claim 1 wherein said second layer of paper or plastic is adhered to the paper sheet by a releasable adhesive which allows at least a portion of the second layer to be released and attached to another surface.

7. Sheetstock for preparing identification cards printed with a printing process of the laser, ionographic or inkjet type; comprising:

a) a first sheet of paper having a top, bottom and an upper and lower surface;

b) a second layer of paper or plastic having a top, bottom, upper and lower surface, said second layer adhered to the upper surface of said first sheet of paper in an overlapping arrangement such that a portion of the lower surface of said second layer is exposed, said layer including a printable plastic adhered to a portion of the upper or lower surface of said second layer, said second layer and plastic layer including a plurality of cuts to define therewith at least one identification card; and c) said first paper sheet further including a third layer of paper or plastic adhered thereto over substantially the remainder of said paper sheet upper surface not covered by said second layer.

8. The sheetstock of claim 7 further including a fourth layer formed of plastic adhered to a portion of said second layer opposite said layer of printable plastic, said cuts being through all layers to allow removal of said cards so defined.

9. Sheetstock for preparing identification cards printed with a printing process of the laser, ionographic, or inkjet type; comprising:

a) a first sheet of paper having an upper and lower surface;

b) a second layer of paper or plastic having an upper and lower surface, an edge of said second layer being oriented adjacent to an edge of said first sheet of paper;

(c) said first sheet and second layer including a printable plastic adhered to a portion of the upper surface of said first sheet and second layer to attach said sheet and second layer together, said second layer and printable plastic layer including a plurality of cuts to define therewith at least one identification card; and d) said first paper sheet further including a third layer of paper or plastic adhered thereto over substantially the remainder of said paper sheet upper surface not covered by said printable plastic.

10. The sheetstock of claim 9 further including a fourth layer of plastic adhered to a portion of the lower surface of said second layer, said cuts being through the layers to allow removal of said cards so defined.

11. Sheetstock for preparing identification cards printed with a printing process of the laser, ionographic or inkjet type; comprising:

a) a first sheet of paper having a top, bottom and an upper and lower surface, said sheet including at least one recessed area on its upper surface, the recessed area upper surface not being coplanar with the remainder of the sheet surface; and b) said first sheet including a printable plastic adhered into each recessed area, said first sheet and plastic layer including a plurality of cuts to define therewith at least one identification card.

12. The sheetstock of claim 11 further including at least one recessed area on the lower surface of said first sheet of paper underneath each recessed area on the upper surface, each of said lower recessed areas including a plastic adhered therein, said first sheet and upper and lower plastic layers including a plurality of cuts to define therewith at least one identification card.

13. The sheetstock of claim 11 further including a layer of plastic adhered to the lower surface of said first sheet beneath said recessed area.

14. The sheetstock of claim 11 further including a magnetic strip across a surface of each of said cards.

15. The sheetstock of claim 11 wherein each identification card includes at least one perforation therethrough through which a line may be passed such that said card may function as a tag.

16. A method for forming laser printed plastic coated identification cards comprising the steps of:

(a) obtaining a supply of sheetstock each formed from a first sheet of paper to which a laser printable plastic has been adhered to a portion of the surface thereof and the remainder of said surface is substantially covered by a second paper layer which is adhered or otherwise bonded to said first sheet of paper, each of said sheets having die cuts on said plastic to define at least one identification card;

(b) aligning said supply of sheetstock in a paper feed tray of a laser printer;

(c) sending information to said laser printer to supply text and any graphics to the printer for application to said sheetstock; and (d) running said printer such that sheetstock is laser printed to include information on each of said identification cards.

17. The method of claim 16 wherein bar codes are imprinted on said cards by said laser printer.

18. Sheetstock for preparing identification cards printed with a printing process of the laser, ionographic or inkjet type; comprising:

a) a sheet of paper having a top, bottom and an upper and lower surface;

b) a first layer of printable plastic adhered to a portion of a surface of said sheet;

c) a second layer of plastic adhered to a portion of a surface of said paper sheet directly opposite said first plastic layer, said paper sheet and plastic layers including a plurality of cuts to define therewith at least one identification card, said cuts being through all layers to allow removal of said cards so defined; and c) said paper sheet further including a second layer of paper or plastic adhered thereto over substantially the remainder of said surface not coated by said second plastic layer.

19. The sheetstock of claim 18 further including a third layer of paper or plastic adhered thereto over substantially the remainder of said paper sheet surface not coated by said first plastic layer.

20. Sheetstock for preparing identification cards capable of being printed with a printing process of the laser, ionographic or inkjet type, comprising:

a) a sheet of paper having an upper and lower surface;

b) a layer of printable plastic adhered to a portion of one surface of said sheet, said sheet and plastic layer including a plurality of closely spaced perforations therethrough to define therewith at least one readily removable identification card; and c) said sheetstock having functionally equivalent thickness in substantially all portions thereof.

21. Sheetstock for preparing identification cards capable of being printed with a printing process of the laser, ionographic or inkjet type, comprising:

a) a sheet of paper having an upper and lower surface;

b) a layer of printable plastic permanently adhered to a portion of one surface of said sheet, forming a composite, said composite having one or more removable sections defining at least one identification card; and c) said sheetstock having equivalent thickness in substantially all portions thereof to facilitate handling in a printing process of the laser, ionographic or inkjet type.

* * * * *

UNITED STATES PATENT AND TRADEMARK OFFICE

CERTIFICATE OF CORRECTION

PATENT NO. : 5,131,686

DATED : July 21, 1992

INVENTOR(S) : Thomas Carlson

It is certified that error appears in the above-indentified patent and that said Letters Patent is hereby corrected as shown below:

Col, 1, line 30, delete "care" and insert -- card --

Col. 1, line 66, delete "fromt" and insert -- from --

Col. 2, line 11, delete "teh" and insert -- the --

Col. 3, line 4, delete "recesed" and insert -- recessed --

Col. 3, line 12, delete "senn" and insert -- seen --

Col. 4, line 25, delete "310" and insert -- 30 --

Col. 4, line 26, delete "suficient" and insert -- sufficient --

Col. 4, line 46, delete "teh" and insert -- the --

Col. 4, line 63, delete "webes" and insert -- webs --

Col. 5, line 10, delete "hte" and insert -- the --

Col. 5, line 33, delete "scabe" and insert -- scab --

UNITED STATES PATENT AND TRADEMARK OFFICE

CERTIFICATE OF CORRECTION

PATENT NO. : 5,131,686

DATED : July 21, 1992

INVENTOR(S) : Thomas Carlson

It is certified that error appears in the above-indentified patent and that said Letters Patent is hereby corrected as shown below:

Col. 6, line 6, delete "top" and insert -- to --

Signed and Sealed this

Thirty-first Day of August, 1993

*Attest:*

*Attesting Officer*

BRUCE LEHMAN

*Commissioner of Patents and Trademarks*